United States Patent [19]

Sidenstick et al.

[11] Patent Number: 4,784,569

[45] Date of Patent: Nov. 15, 1988

[54] SHROUD MEANS FOR TURBINE ROTOR BLADE TIP CLEARANCE CONTROL

[75] Inventors: James E. Sidenstick, Rockport, Mass.; Richard M. Davis, Scotia, N.Y.

[73] Assignee: General Electric Company, Schenectady, N.Y.

[21] Appl. No.: 818,444

[22] Filed: Jan. 10, 1986

[51] Int. Cl.[4] ..... F01D 11/00

[52] U.S. Cl. ..... 415/174

[58] Field of Search ..... 415/116, 134, 138, 170 R, 415/174, 115, 171

[56] References Cited

U.S. PATENT DOCUMENTS

| | | | |
|---|---|---|---|
| 3,176,960 | 4/1965 | Sproule | 415/201 |
| 4,008,978 | 2/1977 | Smale | 415/134 |
| 4,009,568 | 3/1977 | King et al. | 60/39.32 |
| 4,247,247 | 1/1981 | Thebert | 415/113 |
| 4,317,646 | 3/1982 | Steel et al. | 415/116 |
| 4,330,234 | 5/1982 | Colley | 415/171 |
| 4,343,592 | 8/1982 | May | 415/171 |
| 4,385,864 | 5/1983 | Zacherl | 415/174 |
| 4,411,594 | 10/1983 | Pellow et al. | 415/174 |
| 4,431,371 | 2/1984 | Thomson | 415/116 |
| 4,472,108 | 9/1984 | Pask | 415/113 |
| 4,529,355 | 7/1985 | Wilkinson | 415/174 |
| 4,566,700 | 1/1986 | Shiembob | 415/174 |

FOREIGN PATENT DOCUMENTS

| | | | |
|---|---|---|---|
| 182085 | 5/1955 | Fed. Rep. of Germany | 415/174 |
| 310937 | 1/1956 | Switzerland | 415/191 |
| 318278 | 12/1956 | Switzerland | 415/191 |
| 2042646 | 9/1980 | United Kingdom | 415/171 |

*Primary Examiner*—Robert E. Garrett
*Assistant Examiner*—John T. Kwon
*Attorney, Agent, or Firm*—Jerome C. Squillaro

[57] ABSTRACT

A hot gas turbine wheel shroud ring, for hot gas turbine engines, is adapted to be concentrically positioned around the periphery of a row of buckets or blades on the circumference of a turbine wheel to provide a predetermined small sealing and running clearance between the tips of the turbine blades and the ring. The shroud ring is characterized as incorporating certain opposite warping or deflection characteristics from those found in shroud rings under normal high temperature operating conditions.

6 Claims, 1 Drawing Sheet

SHROUD MEANS FOR TURBINE ROTOR BLADE TIP CLEARANCE CONTROL

FIELD OF THE INVENTION

This invertion relates to hot gas turbine machines, and more particularly, to improved shroud means associated with a turbine wheel in such machines.

BACKGROUND OF THE INVENTION

Hot gas turbine machine have found wide application as jet propulsion engines, for example, as aircraft gas turbines, and as electrical power generation plants. Hot gas turbines utilize combustion of a suitable air/fuel mixture in a combustion chamber as a source for hot gas. This hot gas is then directed from the combustion chamber through airfoil turbine blades or buckets mounted in a circular row on the periphery of a turbine wheel disc. These buckets or blades extract energy from the hot gases passing therebetween and convert some of the noted energy into rotational motion of the turbine wheel. The turbine wheel comprising the turbine disc with a row of blades or buckets on the periphery thereof is usually mounted concentrically within an engine casing or housing, and the hot gases are ducted from the combustion chamber through or between the turbine blades usually by means of a suitable annular chamber or duct which is positioned closely adjacent the peripheral row of the buckets or blades which are attached to the periphery of the turbine disc. The annular duct directs most of the combustion gases to the annular area defined by the row of blades on the turbine disc so that most of the hot gas is caused to flow between the blades in the row on the disc. It is important, for energy extraction purposes, that the hot gases pass through or between the turbine blades and not be directed against the face of the turbine disc. In the latter instance a circular shroud ring member is concentrically mounted in the turbine machine casing around the turbine wheel. The shroud ring member may be described as a short cylindrical or rim member with an arcuate surface which fits very closely to the tips of the blades or buckets on the turbine disc. The use of a closely fitting shroud or rim member at the periphery or tips of the blades of a turbine wheel provides a satisfactory gas seal so that most of the hot gases pass between the blades for efficient energy extraction, and very little is lost by passing over the periphery of the blades.

DESCRIPTION OF PRIOR ART

In prior attempts to more precisely control the clearance space between the shroud ring and the blades on the turbine disc over a range of operating conditions, and to maintain minimum clearance at operating temperatures, shroud rings have been made adjustable, such as the sliding ring 18 in U.S. Pat. No. 4,330,234—Colley, or a shroud assembly with a deflectible wall portion is utilized, as described in U.S. Pat. No. 4,247,247—Thebert. However, it is generally undesirable and unsatisfactory to place complex adjustment structures in this high temperature, eroding gas environment, and the kinds of adjustment are limited.

It is important for high efficiency operation of the gas turbine engine, that the clearance zone or space between the outer tips of the turbine blades and the encircling shroud member be kept to a minimum particularly during the usual high temperature operation of the engine.

As described, the shroud ring member, which is ordinarily a metal member, is in direct contact with the hot combustion gases and expands and contracts in accordance with the gas temperature involved. Very high temperatures at the shroud ring raises several problems in the design of hot gas turbines. It is desirable that the shroud ring maintain a minimal distance between itself and the outer tips of the turbine blades to minimize hot gases passing over the periphery of the blades rather than between the blades. While the shroud should have a minimum spacing from the turbine blades, it must not come in contact with the rotating blades as the resulting metal loss caused by the rubbing will result in significant performance loss.

In some hot gas turbine engines the temperature of the hot gas in contact with the shroud may elevate the temperature of the shroud ring to an extremely high level. As a consequence, shroud rings have been known to radially inwardly deform or warp to such an extent that the noted clearance space is significantly altered and the shroud ring may come in damaging contact with the rotating turbine blades.

SUMMARY OF THE INVENTION

In accordance with the present invention a shroud ring has incorporated therein, certain predetermined reverse deformation characteristics. The deformation usually encountered in a hot gas turbine engine at the usual engine operating temperatures, is a bowing or a radially inwardly curving of the arcuate cross section of the shroud ring or rim toward the blades on the turbine disc. This deformation can cause damaging contact between the ring and the turbine blades or a deleterious change in the running clearance or sealing space between the ring and the turbine blades. Accordingly, a shroud ring is employed which incorporates a predetermined reverse curvature, and the ring may then deform in the usual manner to the extent of the predetermined reverse curvature and yet maintain the running clearance of the turbine blades, for effective sealing.

DESCRIPTION OF A PREFERRED EMBODIMENT

Figure 1:
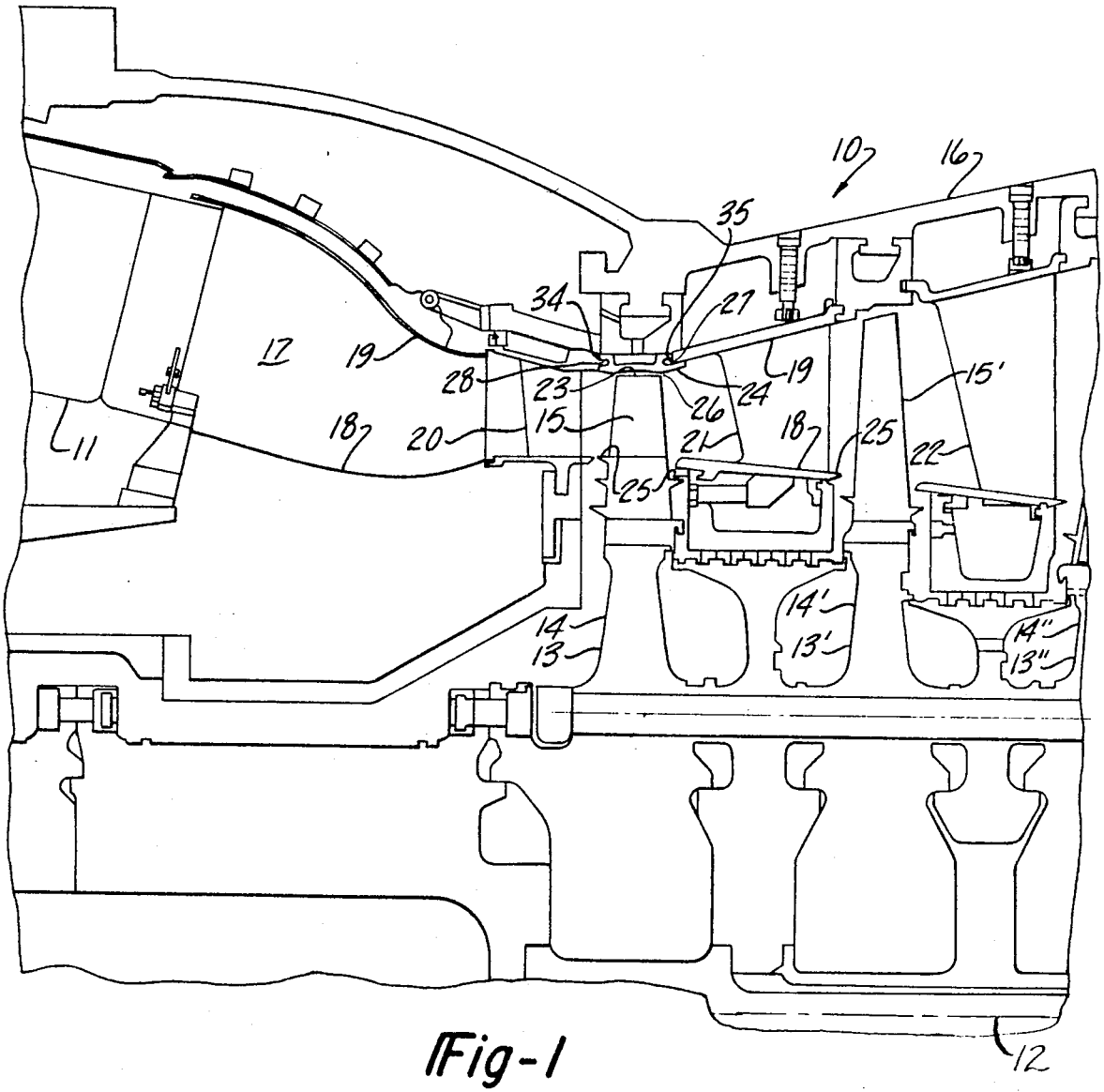
FIG. 1 is a partial and quarter cross-sectional view of a hot gas turbine engine illustrating a turbine wheel with an associated improved shroud assembly.

Referring now to FIG. 1 there is illustrated a partial and quarter cross-sectional view of a gas turbine engine 10. In engine 10 there is shown, by way of example, one combustion chamber 11. For aircraft engines, a single annular combustion chamber is typically employed. However, for heavy duty type engines, ordinarily a plurality of combustion chambers 11 are employed in each engine 10. In one example fourteen such combustion chambers 11 are mounted in a circular or annular row about the centerline 12 of the engine 10 and concentric with one or more turbine wheels 13, 13' and 13".

Each turbine wheel 13, 13' and 13" comprises a rotor or disc 14, 14' and 14" (not shown) with a spaced array of airfoil blades or buckets 15, 15' and 15" (not shown) mounted on the periphery thereof. Combustion chamber 11 represents the fore end of engine 10 and the combustion gases therefrom pass first through or between blades 15 or tubine wheel 13 and then through blades 15' and 15'' of turbine wheels 13' and 13'' to an appropriate exhaust duct (not shown). Combustion gases from the combustion chambers pass into a suitable annular duct or chamber which channels the hot gases directly to the annular area defined by the rows of blades 15, 15' and 15'' of the turbine wheels 13, 13' and 13''.

As illustrated in FIG. 1, one or more turbine wheels 13, 13' and 13'' are mounted in axially spaced relationship concentrically in the housing or casing 16 of engine 10. The turbine wheel 13 next adjacent the combustion chamber 11 is referred to as the first stage turbine wheel or rotor. Between the combustion chamber 11 and the turbine wheels 13, 13'' and 13'' there is provided an annular chamber or passage 17 defined by an inner wall 18 and an outer wall 19. Annual passage 17 directs hot gases from the combustion chamber 11 through or across the rows of blades 15, 15' and 15'' and defines a volumetrically increasing hot gas passage through and across each row of blades 15, 15' and 15'' on each turbine wheel 13, 13' and 13'', and thereafter to an appropriate exhaust (not shown). Since the individual turbine wheels impart some circular or lateral motion to the hot gas flow, suitable guide vanes or nozzles 20, 21 and 22 are provided in annular passage 17 next adjacent each turbine wheel to redirect the hot gases for optimum directional impingement with the turbine wheel blades. Annular chamber 17 increases in size progressively in the aft direction to accommodate the expanding hot gases passing therethrough. The circular row of turbine blades 15 of turbine rotor 13 extend radially into the annular chamber 17, i.e., into the hot gas flow and the first stage turbine blades 15 have arcuate outermost tips 23 which lie closely adjacent the inner surface of a shroud ring 24 in wall 19 of casing 16. The hot gases flowing from the combustion chamber 11 are directed by means of annular passage or chamber 17 to the defined annular area of the rows of blades 15, 15' and 15'' on the turbine wheel discs 14, 14' and 14''. It is important that as much of the hot gas flow as possible be directed between the turbine blades so that there is an optimum extraction of energy from the hot gas to impart rotational energy to the turbine wheels. Some of the hot gases flowing through annular chamber 17 may escape passing between blades 15 by flowing radially inwardly along the disc surfaces of the turbine wheels, and appropriate air seals 25 are utilized between a rotor disc 13 and an adjacent surface of casing 16. These seals 25 inhibit the passage of hot gases from annular passage 17 radially inwardly to discs 14, 14' and 14'' and consequently more of the hot gases in annular chamber 17 are directed through turbine blades 15. Some of the hot gases also bypass turbine blades 15 at the tip clearance space or zone 26 where the blade tips 23 come into close proximity with casing 16. This clearance zone 26 is very important. The clearance space 26 between blades tips 23 and casing 16 should be kept to a minimum particularly during engine operation to prevent hot gases from bypassing the turbine blades. At the same time, clearance zone 26 and adjacent engine structure are subject to extremely high temperatures, maximum expansion of metal parts, and eroding hot gases. If a rotor assembly or casing should deform extensively the blades 15 on a rotor disc 14 which is rotating at several thousand RPM, could come into rubbing contact with the casing 16 with undesirable results in performance of the engine 10. Accordingly, it is a common practice to install various kinds of shroud rings in casing 16 particularly at the first stage turbine in an attempt to provide minimum clearance and an effective gas seal at varying temperatures and engine operating conditions. One shroud ring in accordance with the practice of this invention is illustrated as ring 24 in FIG. 1.

Referring again to FIG. 1, shroud ring 24 is an annular band member fitted in casing 16 concentrically about turbine wheel 13, so that its inner surface closely overlies the tips 23 of turbine blades 15 to define the narrow clearance space 26. In the cross-sectional view as illustrated in FIG. 1, ring 24 appears as a simple beam resting on two spaced-apart shelf or lip supports 27 and 28 in casing 16.

In the illustrated arrangement of FIG. 1, which is exaggerated for the purpose of clarity, it has been found that with the extreme temperatures involved at operating conditions a shroud ring 24 tends to warp or deform in a predetermined manner at the first stage turbine. There is a large temperature differential across the shroud ring from the fore edge, the edge facing in the direction of the combustion chamber 11 and the aft or opposite edge which contributes to the deformation.

The shroud ring "beam structure", a term utilized only for descriptive purposes herein, tends to deflect or bow radially inwardly from its supports 27 and 28 downwardly (opposite to the exaggerated curve of FIG. 1) towards the blades 15. Such warping or deflecting leads to gas flow problems since the aerodynamic flow path in this zone should be as cylindrical as possible. Increased deflection or bowing could also lead to damaging contact of the shroud ring with moving blades 15.

The deflection noted appears to flow a smooth curve along the central longitudinal axis direction of the annular shroud ring 24 from the fore edge to the aft edge, and radially inwardly from its supports 27 and 28, towards the flat peripheral tips 23 of blades 15.

It has now been discovered that the problem of a warping or deforming shroud ring as described may be alleviated without resort or adjusting mechanisms or complex temperature expansion compensation procedures or deformation.

It has been found advantageous to make up a continuous shroud ring from a plurality of arcuate segments, which, when mounted in an engine casing in side by side relationship form a continuous annular shroud ring.

Figure 2:
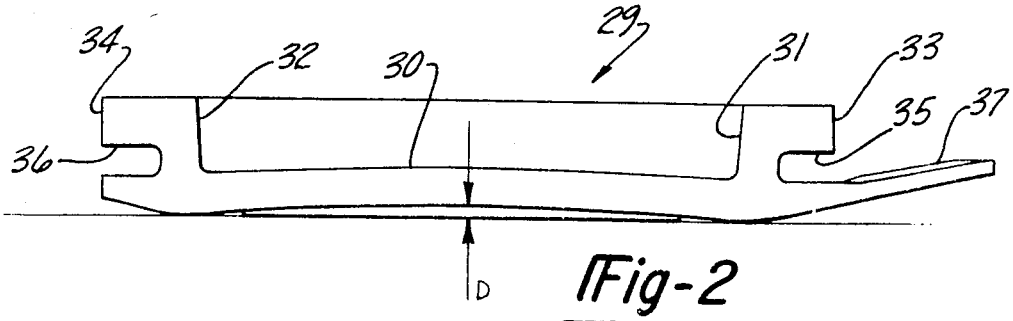
FIG. 2 is a partial cross-sectional view of an arcuate segment of a shroud ring incorporating the predetermined curvature of this invention.

FIG. 2 is a cross-sectional view of one arcuate segment 29 of a shroud ring such as ring 24 of FIG. 1 incorporating the practice of this invention. For the purpose of clarity the ring radius curvature of segment 29 is not shown. As illustrated in FIG. 2, the ring segment 29, in cross-section, comprises a U shape or channel member having a bottom wall 30 and spaced apart upstanding walls 31 and 32 with axially opposite faces 33 and 34. In each face 33 and 34 there is a defined axially penetrating groove 35 and 36. Grooves 35 and 36 extend circumferentially over the total circumference of the ring at the groove radius from centerline 12. These grooves are a part of a tongue and groove connection and interfit with tongues or supports 27 and 28 in casing 16 to retain ring 24 in its illustrated position. At the aft or downstream wall 31 of the shroud ring segment 29, there is an upwardly tapered and extending shelf surface 37. This shelf surface 37 tapers so that there is a smooth fit of the shelf with the corresponding tapering wall 19 of the expanding annular chamber 17 for a smooth aerodynamic surface for hot gas flow.

Referring again to FIG. 2, and in accordance with the practices of this invention, shroud ring segment 29 includes a concave surface which may be described as an opposite curvature or concave surface with a deflection D in bottom wall 30 measured from the horizontal to the point of greatest deflection which is midway between the fore end at wall 32 and the aft end at wall 31. This opposite cuvature in the form of an arch is more clearly shown with some exaggeration in ring 24 of FIG. 1. The amount or degree of deflection D of FIG. 2 is substantially the same as the usual deflection found in prior shroud rings. However, the direction of deflection D of FIG. 2 is in a direction opposite to the direction of deflection noted in prior rings and deflection D is incorporated therein in a reverse direction as a part of the manufacturing process thereof. In one example of the problem to which this invention is directed, the deflection D was found to be about 0.03 inch (0.76 mm). This deflection is a curvature found in the bottom wall 30 of shroud ring 24, and may be described as having, for example, a spherical radius. However, other deformation curves are possible and the invention is not limited to any particular shape of deformation. With reference to FIG. 2, the deformation curvature has a radius in the lateral direction following the curve of the ring and the periphery of the bladed turbine wheel. It also has a radius extending from the engine centerline to the shroud ring and sweeping in the fore and after direction. Such a curvature with two radii is sometimes referred to as a bowl or dished surface. Accordingly, if surface 30 is dished 0.03 inch (0.76 mm) in an opposite direction, then after deformation at high temperature, the anticipated or usual 0.03 inch deformation should bring the bottom wall 30 to a neutral or the design position.

This reverse curvature or concave surface in ring 24 permits ring 24 to deform under elevated temperatures to the extent noted in prior rings, without any significant change in the original design clearance between ring 24 and turbine blades 15 and without danger of rubbing contact between the turbine blades and the ring. At the same time a desirable minimum running clearance is retained thus obviating a prior art practice of having an excessive original clearance in contemplation of expansion deformation at elevated temperatures with resultant lower clearance. Wall 30 is described as having a concave surface which arches over the blades 15 from the fore end to the aft end thereof.

While a preferred embodiment of this invention has been shown and described, it will be obvious to those skilled in the art that various changes and modifications may be made therein without departing from the scope of the invention as defined by the appended claims.

What is claimed is:

1. A shroud ring for a hot gas turbine engine having a casing, a turbine wheel concentrically mounted in said casing and a combustion chamber to supply hot gases to said turbine wheel, (a) said casing having a radially tapering wall therein along which said hot gases flow, (b) said shroud ring being fixedly positioned in said casing concentrically about said turbine wheel, (c) said shroud ring having a cross-section illustrating a generally U shape or channel member having a bottom wall and a pair of opposite upstanding walls with oppositely directed faces, (d) said channel member being formed in an annular or ring configuration with said sidewalls being in a radially outward and upstanding relationship with respect to said bottom wall, (e) said bottom wall having a radially outwardly directed curve or bow therein between said sidewalls.

2. The invention as recited in claim 1 wherein said curve has a maximum depth of about 0.03 inch (0.76 mm) measured from a horizontal plane contacting said bottom wall.

3. The invention as recited in claim 1 wherein each said opposite face of each said side wall defines an axially penetrating groove the therein, and a tongue projection in the casing of said hot gas turbine engine, said tongue projection fitting in said groove to fixedly retain said shroud ring in said casing.

4. The invention as recited in claim 1 wherein one of said sidewalls includes an axially extending and upwardly tapering arcuate shelf surface member adapted to fit with and conform to said radially tapering wall in said casing along which hot gases flow.

5. A shroud segment for a gas turbine, said shroud segment having a cross-section illustrating a generally U-shaped or channel member with a bottom wall and a pair of opposite upstanding walls with oppositely directed faces the channel member being of an annular configuration with said sidewalls being in a radially outward and upstanding relationship with respect to said bottom wall and wherein the bottom wall has a radially outward directed curve or bow therein between said sidewalls.

6. The shroud segment of claim 5 wherein said curve or bow is spherical in shape.

* * * * *